US006748763B2

(12) United States Patent
Schweigert et al.

(10) Patent No.: US 6,748,763 B2
(45) Date of Patent: Jun. 15, 2004

(54) MULTISTOREYED BATH CONDENSER

(75) Inventors: Karl Heinrich Schweigert, Munich (DE); Alfred Wanner, Munich (DE); Thomas Hecht, Gauting (DE); Manfred Sotzek, Munich (DE)

(73) Assignee: Linde AG, Wiesbaden (DE)

( * ) Notice: Subject to any disclaimer, the term of this patent is extended or adjusted under 35 U.S.C. 154(b) by 0 days.

(21) Appl. No.: 10/296,961

(22) PCT Filed: May 31, 2001

(86) PCT No.: PCT/EP01/06207

§ 371 (c)(1),
(2), (4) Date: Mar. 7, 2003

(87) PCT Pub. No.: WO01/92799

PCT Pub. Date: Dec. 6, 2001

(65) Prior Publication Data

US 2003/0159810 A1 Aug. 28, 2003

(30) Foreign Application Priority Data

May 31, 2000 (DE) ..... 100 27 139
Jul. 21, 2000 (EP) ..... 00115782

(51) Int. Cl.[7] ..... F25J 3/00; F28F 9/26; F28F 9/22

(52) U.S. Cl. ..... 62/620; 62/903; 165/143; 165/145

(58) Field of Search ..... 62/620, 643, 903; 165/110, 143, 145

(56) References Cited

U.S. PATENT DOCUMENTS

| | | | | | |
|---|---|---|---|---|---|
| 2,004,390 | A | * | 6/1935 | Benzinger | 165/71 |
| 3,880,231 | A | * | 4/1975 | Gauthier | 165/166 |
| 5,144,809 | A | * | 9/1992 | Chevalier et al. | 165/166 |
| 5,148,858 | A | * | 9/1992 | Ovretveit | 165/282 |
| 5,222,549 | A | * | 6/1993 | Ishii et al. | 165/110 |
| 5,385,203 | A | * | 1/1995 | Mitsuhashi et al. | 165/110 |
| 6,128,920 | A | * | 10/2000 | Matsuo et al. | 62/627 |

* cited by examiner

*Primary Examiner*—William C. Doerrler
(74) *Attorney, Agent, or Firm*—Millen, White, Zelano & Branigan, P.C.

(57) ABSTRACT

The invention relates to a bath condenser with a condenser block (1) that has evaporation passages (8) for a liquid and liquefaction passages (2) for a heating medium. The condenser block (1) has at least two circulation sections (7) that are located on top of one another, the evaporation passages (8) each having on the lower end of a circulation section (7) at least one entry opening (9) for the liquid and on the upper end of the circulation section (7) at least one exit opening (10). Only exit openings (10) and entry openings (9) that are located on the same side (12) of the condenser block (1) are connected via means (17, 30) for routing the liquid.

20 Claims, 3 Drawing Sheets

Figure 1:
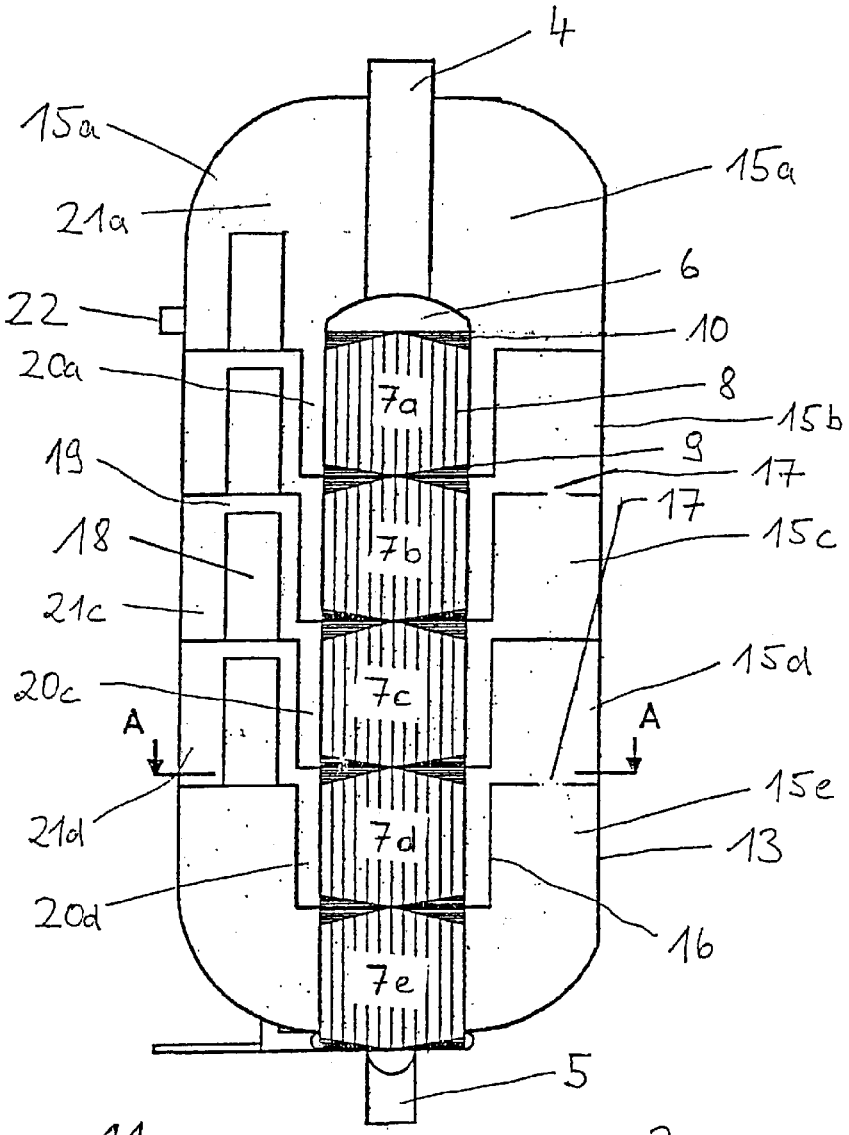

Figur 3
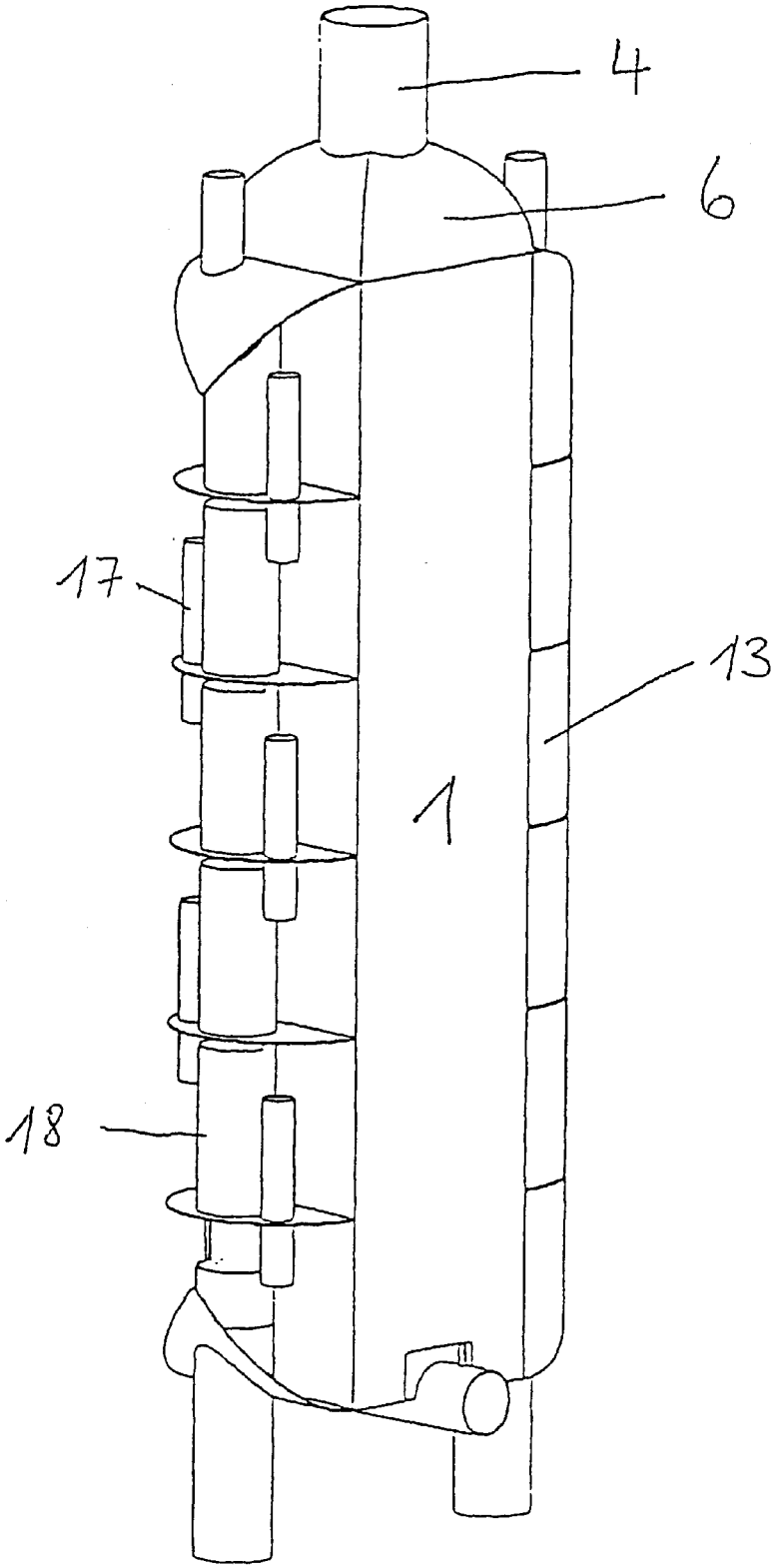

Figur 4
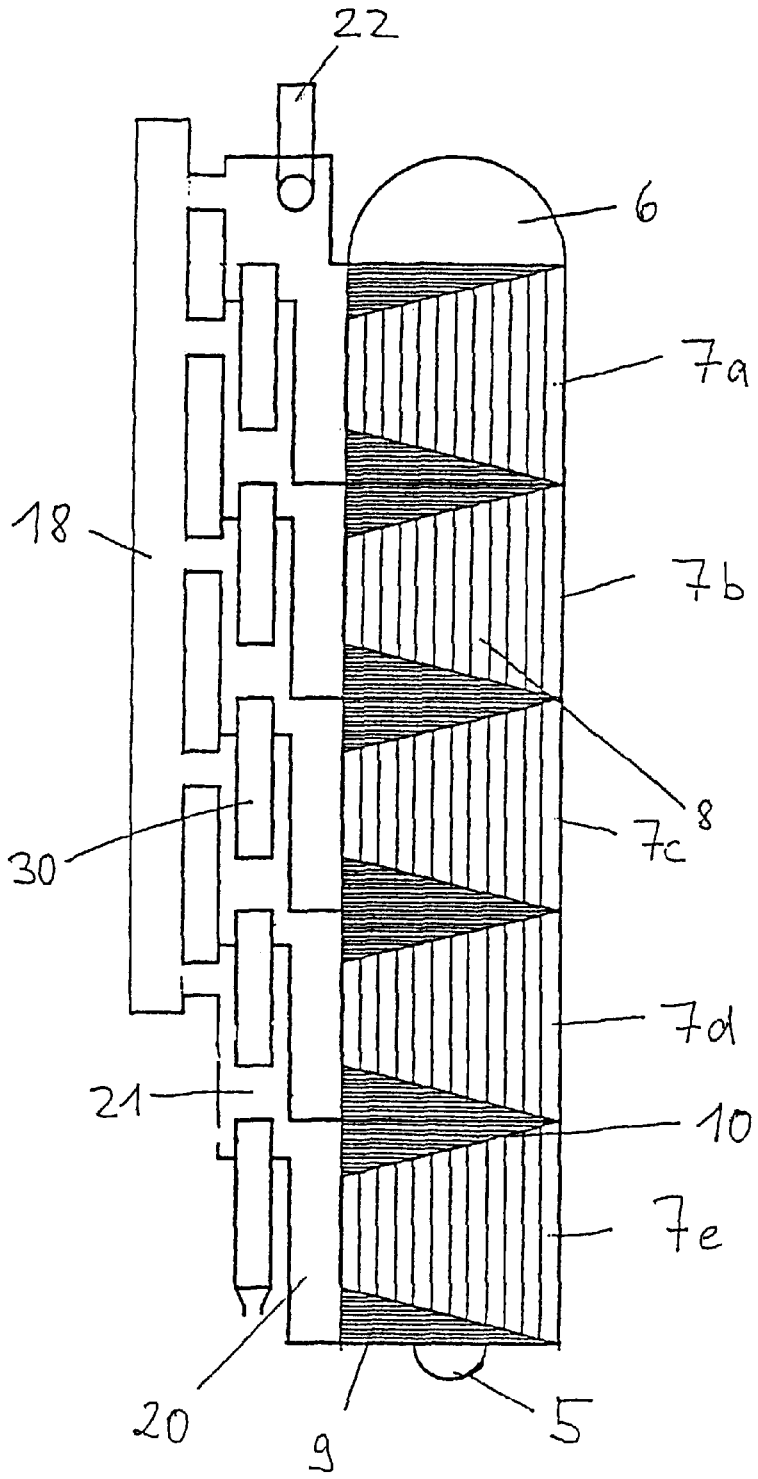

MULTISTOREYED BATH CONDENSER

The invention relates to a bath condenser with a condenser block that has evaporation passages for a liquid and liquefaction passages for a heating medium and at least two circulation sections that are located on top of one another, the evaporation passages each having on the lower end of a circulation section at least one entry opening for the liquid and on the upper end of a circulation section at least one exit opening, and there being means for routing liquid from an exit opening of one circulation section to an entry opening of the underlying circulation section.

In a low-temperature air separation system with a pressure column (commonly referred to as a high pressure column) and a low-pressure column, liquid oxygen from the low-pressure column is evaporated against gaseous nitrogen from the pressure column in indirect heat exchange in a heat exchanger, the nitrogen condensing.

The heat exchanger is implemented essentially in two different basic forms. In a falling-film evaporator, the liquid to be evaporated is delivered at the top to the evaporation passages via a distribution system that at the same time forms a gas seal. The liquid runs down as a liquid film over the heating surface, its being partially evaporated. The resulting gas and the unevaporated residual liquid emerge at the bottom from the falling-film evaporator. The liquid collects in the collecting space located under the condenser, while the gas portion is relayed on.

In a bath condenser, on the other hand, the condenser block is in the liquid bath from which liquid is to be evaporated. The liquid from underneath enters the evaporation passages of the condenser block and is partially evaporated against the heating medium that flows through the liquefaction passages. The density of the medium that is evaporating in the evaporation passages is less than the density of the surrounding liquid bath, resulting in a siphon action, so that liquid from the liquid bath flows into the evaporation passages. The greater the immersion depth of the condenser block in the liquid bath, the higher the average hydrostatic pressure becomes in the evaporation passages and the more poorly the liquid evaporates, since the boiling point of the liquid rises according to the vapor pressure curve.

The efficiency of a bath condenser can therefore be increased by dividing the condenser block into several sections that are located on top of one another, hereinafter called circulation sections. The advantage of one such arrangement is that the immersion depth for several circulation sections is smaller than for a single high condenser block. Thus, the hydrostatic pressure in the evaporation passages becomes less, and the liquid can evaporate more easily.

German patent application 199 39 294 discloses a multistory bath condenser in which there are two condenser blocks parallel to one another and in which between the blocks for each story there are liquid storage tanks for the liquid that is to be evaporated. The evaporation passages are divided vertically into several stories that each form its own circulation section, Thus the immersion depth is kept relatively small.

In the individual circulation sections, liquid flows from underneath into the evaporation passages and emerges again as a liquid-gas mixture on the top end of the circulation section on the side of the condenser block that is opposite the entry side. The emerging liquid is routed around the condenser block via lines and flows back again into the liquid storage tank. The complex piping and large space requirement that arise due to the two parallel condenser blocks and the necessary piping are disadvantageous in this arrangement.

The object of this invention is therefore to develop a compact multistory bath condenser.

This object is achieved by a bath condenser of the initially mentioned type, in which the means for routing the liquid connect only exit openings and entry openings that are located on the same side of the condenser block.

As claimed in the invention, the bath condenser consists of at least two circulation sections that are located on top of one another and that are each supplied with liquid from its own liquid storage tank. The vertical subdivision of the bath condenser can greatly reduce the liquid level in the liquid storage tanks of the respective circulation sections relative to the liquid level in the single continuous condenser block.

The liquid enters the evaporation passages via the entry openings that are located on the bottom end of a circulation section, flows upward, partially evaporates and leaves the passages on the top end of the circulation section via suitable exit openings. The liquid portion in the liquid-gas mixture emerging from the passages flows, on the one hand, back to the entry openings of this circulation section, and, on the other hand, depending on the liquid level in the liquid storage tank of the circulation section, to the entry openings of the underlying circulation section in order to be overturned there in turn via the evaporation passages.

The exit and entry openings between which liquid flows are all located on the same side of the condenser block in the bath condenser as claimed in the invention. Therefore, complex piping is not necessary to repeatedly overturn the liquid within a circulation section or to feed it to an adjacent circulation section.

Preferably at most two sides of the condenser block are provided with entry and/or exit openings. As claimed in the invention, however, the entry and exit openings that are located on different sides of the condenser block are not connected to one another on the liquid side outside of the condenser block, i.e., the liquid that emerges from an exit opening on one side of the condenser block cannot flow into an entry opening that is on the other side of the condenser block. Within the condenser block, however, fundamentally exchange of liquid between the evaporation passages to a small degree is possible, since the corrugated sheets that separate the individual evaporation passages from one anther are often perforated. If there are entry and exit openings on both sides of the condenser block, the condenser block has two parallel groups of evaporation passages between which no liquid is exchanged. The liquid emerging from the exit openings on one side is routed exclusively in the evaporation passages with entry openings that are likewise located on this side.

In an especially preferred embodiment, on the two opposing sides of the condenser block, there are entry and exit openings to the evaporation passages in each case. In this case, it is especially advantageous if the condenser block is built mirror-symmetrically to the center plane between these two sides.

A more compact execution of the bath condenser can be achieved by all entry and exit openings being located on the same side of the heat exchanger. Lines to connect the entry or exit openings to one another are only necessary on the outside of the condenser block. The other three lateral boundaries of the bath condenser are formed by the outside walls of the condenser block. If nothing else arises from this connection, the indications "top", "bottom" and "laterally" each relate to the alignment of the condenser that is present during operation of the bath condenser and in which the individual circulation sections are located essentially vertically on top of one another.

Preferably the flow connection between the entry or exit openings and the evaporation passages is produced by horizontally or obliquely running channels. The condenser block is built from several corrugated plates that are stacked on top of one another and that are each bordered by flat partitions. In this case, the plates and partitions form the liquefaction and evaporation passages. In the area of the entry or exit openings to the evaporation passages, the corrugated plates are arranged slanted so that fluid that flows into the evaporation passages that run vertically is deflected to the entry or exit openings that are located in a side wall of the condenser block.

The side of a circulation section in which the entry and/or exit openings are located is advantageously provided with a collector that has a liquid feed line and a gas offtake. A circulation section generally has rectangular side walls. The collector covers at least the entry and exit openings of the side wall of the circulation section, but preferably the entire side wall of the circulation section. The walls of the collector and the side wall of the circulation section therefore form a volume that is shielded against the environment and that is gastight and liquid-tight except for the feed lines and offtake that are intended for this purpose.

The bath condenser in this variant is bordered laterally by the side walls of the condenser block, or on the sides on which the entry and/or exit openings are located, by the outside walls of the collectors. A separate tank around the bath condenser is not necessary, by which the condenser becomes extremely compact. In this way, material for the tank wall is saved and the entire length of the welds necessary for production is greatly reduced, by which production is simplified. Moreover, smaller wall thicknesses can be selected for the collector than for the otherwise necessary tank wall, since the diameters of the collectors need not be made as large as that of the tank around the condenser block. This provides a considerable savings in costs.

It has been found to be especially advantageous to cover the sides of several circulation sections, especially the entire side of the condenser block in which the entry and/or exit openings are located, with a collector that is provided with a liquid feed line and a gas offtake. In this collector, for each circulation section there is a suitable liquid storage tank. Furthermore, in the collector or on the collector, there are lines or openings for delivery and discharge of liquid and/or gas into and out of the circulation section.

Preferably the collector on the boundary of two circulation sections is divided in each case into stages, two adjacent stages being connected to one another on the flow side via one liquid line and one gas line. The collector that extends over the height of several circulation sections, preferably over the entire height of the condenser block, is divided into stages according to the circulation sections. The stages are delineated against one another preferably by flat sheets or elbowed bottoms. It is especially favorable if the individual stages are delineated gas-tight and liquid-tight against one another except for flow connections that are intended especially for this purpose such that the volume of one stage can be used as the liquid storage tank for the bordering circulation section.

Liquid transport from one stage to the underlying stage is advantageously ensured via an overflow pipe. The bottom of one stage of the collector is penetrated by the overflow pipe with an opening located above the bottom. The liquid that flows into this stage from the circulation section collects on the bottom of the stage and drains into the underlying stage only when the liquid level has reached the height of the opening of the overflow pipe. At a lower liquid level, the liquid is overturned only in the upper of the two stages.

By dividing the collector into several stages, essentially only the gas that has been evaporated in the assigned circulation section flows through one stage. The gas velocities in one stage are therefore relatively low, especially much lower than in a bath condenser in which there is no separation of the collecting areas for the gas. In this way, the danger that the evaporated gas will entrain so much liquid that the liquid level drops to under the opening to the flow connection to the adjacent stage, for example to under the entry edge of the overflow pipe, is avoided.

The danger of the entrainment of liquid can advantageously be further reduced by the entry into the gas line of one stage being located above the exit opening of the evaporation passages of the stage. The gas that has evaporated in the circulation section must rise a certain distance before it enters the gas line by which it is discharged from the stage. The volume between the exit opening from the circulation section and the inlet into the gas line is used as an additional separation space in which the liquid that is entrained with the gas is separated from the gas flow.

It has proven especially favorable to provide the gas inlet of the gas line on the side that faces away from the exit opening of the evaporation passages. The gas that emerges from the exit opening is then deflected again in the stage before it enters the gas line, by which the liquid is more easily separated from the gas flow.

The construction effort for the collector can be kept low by the collector in a plane perpendicular to the liquefaction and evaporation passages having a semicircular or semielliptical cross-section, i.e., implemented, for example, by a sheet that has been bent into a semicircle and that is connected to the two edges of the condenser block side that is provided with the entry or exit openings.

The liquid or gas lines that connect two stages to one another or that discharge gas from one stage run preferably within the collector. Especially preferably both the liquid and also the gas line are housed within the collector. The bath condenser therefore remains extremely compact and is bordered to the outside only by the outside walls of the condenser block and the collectors. No lines run laterally outside of these boundaries over most of the body of the bath condenser. Only at least one feed line and one offtake at a time for the fluid to be evaporated and the fluid to be condensed are, of course, necessary. They preferably emerge on the top and bottom ends of the bath condenser.

Preferably there is one gas line that extends through all stages and that has one gas inlet in each stage.

The bath condenser as claimed in the invention can be advantageously used especially as the main condenser of a low-temperature air separation system.

Figure 2:
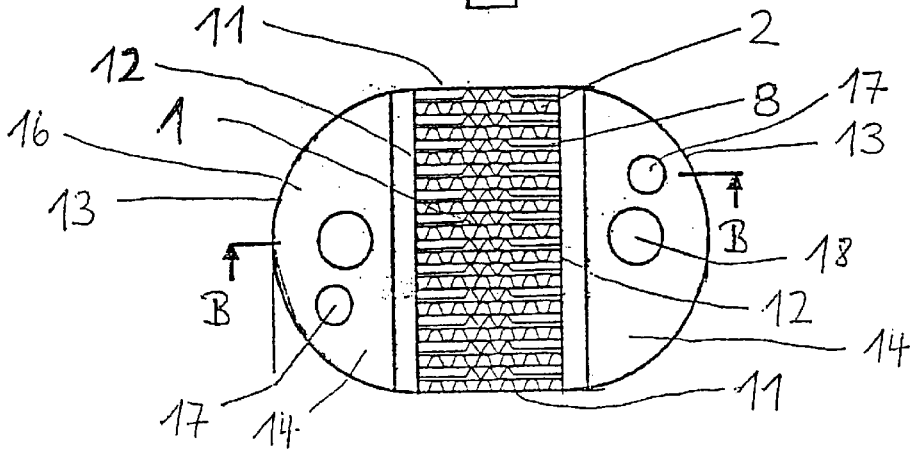

The invention and other details of the invention are detailed below using the embodiments shown in the drawings. Here:

FIG. 1 shows a section through a bath condenser as claimed in the invention along line B—B in FIG. 2, FIG. 2 shows a section through the same bath condenser along line A—A in FIG. 1, FIG. 3 shows a perspective view of an alternative embodiment, and FIG. 4 shows a section through another embodiment of the invention.

FIGS. 1 and 2 show two sections through a bath condenser as claimed in the invention that is used as the main condenser of a double column of an air separation system. The main condenser can be located either in the low-pressure column of the double column or, preferably, outside of the double column. FIG. 1 shows a section along line B—B in FIG. 2, and FIG. 2 shows a section along line A—A of FIG. 1. The bath condenser consists of a condenser block 1 that contains a host of heat exchange passages 2, 8 that run parallel and in which gaseous nitrogen is condensed in heat exchange with liquid oxygen, the oxygen being evaporated.

The nitrogen passages 2 extend over the entire height of the condenser block 1. Gaseous nitrogen is supplied via a feed line 4 to the nitrogen passages 2 and is withdrawn as liquid on the bottom end of the block 1 via the line 5. Distribution of the gaseous nitrogen among the nitrogen passages 2 takes place via a collector/distributor 6 that is connected to the condenser block 1. The liquid nitrogen that emerges from the heat exchange passages of the condenser block 1 is analogously funneled in the drain line 5.

The oxygen passages 8 do not extend, in contrast to the nitrogen passages 2, over the entire length of the condenser block 1, but are divided into 5 circulation sections 7*a* to 7*e*. Each circulation section 7*a–e* is built mirror-symmetrically to the center plane of the condenser block 1 that runs vertically. Each of these two symmetrical halves consists of heat exchange passages 8 that adjoin the passages 9, 10 that run horizontally on the top and bottom end of a circulation section 7 and that are used for delivery and drainage of the liquid and gas into the oxygen passages 8. The entry and exit passages 9, 10 of the two symmetrical halves of a circulation section 7 each end on the same side of the condenser block 1.

The circulation sections 7*a* to 7*e* are all built identically. The condenser block 1 thus has two sides that are closed by one termination sheet 11 at a time and two opposing sides 12 in which for each circulation section 7*a–e*, there is one entry opening 9 for liquid oxygen and one exit opening 10 for partially evaporated oxygen.

Half-cylinder shells 13 that cover all side surfaces 12 are connected to the two sides 12 of the condenser block 1 that are provided with entry and exit openings 9, 10. The half-cylinder shells 13 end with the vertical edges of the cuboidal condenser block 1 and form a collector. The two spaces 14 that are bordered by the side walls 12 and the half-cylinder shells 13 and that are located on opposing sides of the condenser block 1 are not connected to one another over the run of the height of the condenser block 1. The sole connection between the two spaces 14 is above the condenser block 1 since the half-cylinder shells 13 are higher than the condenser block 1 and are connected to one another in the area above the condenser block 1. The bath condenser therefore consists of a condenser block 1 that adjoins the two half-cylinder shells 13 on both sides 12 and of a head part 21*a* that spans the condenser block 1 and the two half-cylinder shells 13.

The spaces 14 bordered by the half-cylinder shells 13 are subdivided by sheets 16 into several collectors as well as stages 15*a* to 15*e*. The sheets 16 extend from the borders between two circulation sections 7 to the half-cylinder shell 13 that is located on this side of the condenser block. In the sheets 16, there are drain openings through which liquid oxygen can drain from one stage, for example 15*b*, into the underlying stage, for example 15*c*. Furthermore, gas shafts 18 that extend from one sheet 16 to barely underneath the sheet 16 that lies overhead are connected to the sheet 16.

The gas shafts 18 are arranged in a line and thus form essentially a common gas collecting line, but between the top end of each gas shaft 18 and the overlying sheet 16 a gap 19 remaining that enables entry of gas from the respective stage 15 into the gas collecting line. The sheets 16 run at least partially rising upward so that the annular gap 19 is above the exit openings 10 of the respective stage 15.

In the example shown in FIG. 1, the sheets 16 are folded twice at a right angle so that between two sheets 16 a stage 15 is formed that consists of two spaces 20, 21 that are connected to one another. The space 20*c* is located at the height of the pertinent circulation section 7*c* and is used as a liquid storage tank. The second space 21*c* is conversely almost at the same height as the next higher circulation section 7*b* and forms a type of additional pocket that is offset above and laterally to the liquid storage tank 20*c*.

In the operation of the bath condenser, liquid oxygen is delivered to the two uppermost stages 15*a* via the line 22. The oxygen collects first in the storage tank 20*a*, enters the oxygen passages 8 via the entry passages 9, is partially evaporated in indirect heat exchange with nitrogen, and leaves the condenser block 1 as a liquid-gas mixture via the exit passages 10 in order to collect again in the storage tank 20. When the liquid level in the storage tank rises to the height of the exit channels 10, liquid oxygen can flow via the connecting gap into the second space 21*a* that is used as a separation space.

The separation space 21*a* in its bottom has drain openings 17 through which excess liquid oxygen can flow from the stage 15*a* into the underlying stage 15*b*. In this case, the drain openings 17 of two adjacent stages 15 are arranged offset to one another so that, for example, oxygen dripping from the stage 15*b* does not continue to flow directly into stage 15*d*, but remains first in the stage 15*c*.

The drain openings 17 are preferably located at least as high as the exit openings 10 of the pertinent stage 15. It has proven advantageous to immerse the individual circulation sections 7 of the bath condenser in the liquid bath at least to such an extent that the liquid level in the storage tank 20 is at least barely underneath the bottom edge of the exit openings 10. In this way, complete evaporation in the evaporation passages 8 is precluded, and shifting of the passages 8 by high-boiling components is prevented.

The oxygen draining into the stage 15*b* collects again in the storage tank 20*b*, is overturned in the circulation section 7*b* and partially evaporated. Excess liquid in the storage tank 20*b* runs via the drain opening 17 into the stage 15*c*. The oxygen gas that forms during evaporation in the circulation section 7 flows with the liquid oxygen out of the exit openings 10 and is discharged via the gas shaft 18. These processes repeat in each stage 15.

The oxygen gas is repeatedly deflected by the arrangement of the separation space 21 that is offset laterally and to the top and the annular gas inlet 19 into the gas shaft 18 before it is discharged from the stage 15. In these deflections the flow velocity of the gaseous oxygen is lowered so dramatically that the latter does not entrain any, or hardly any, oxygen that is still liquid. In the separation space 21, therefore, very good liquid-gas separation is achieved. The oxygen gas rising through the gas shafts 18 is discharged at the top end of the bath condenser via an oxygen discharge line that is not shown in the drawings.

FIG. 3 shows in perspective a variant of the bath condenser as claimed in the invention. This embodiment differs from the condenser explained using FIGS. 1 and 2 essentially in that the two half-cylinder shells 13 have no flow connection at all to one another. The half-cylinder shells 13 end with the two open sides 12 of the condenser block 1. By abandoning the head part 21*a* that spans the condenser block 1 and the two half-cylinder shells 13, the condenser is more compact than the bath condenser according to FIGS. 1 and 2, but requires twice as many connecting branches or pipes for the feed line and offtake of the liquid and gaseous oxygen.

FIG. 4 shows another embodiment of the bath condenser as claimed in the invention, in which the oxygen passages 8 have entry and exit openings 9, 10 only on one side of the condenser block 1. The nitrogen passages that are not shown correspond to the passages 2 in FIG. 2 and extend likewise over the entire height of the condenser block. The nitrogen gas that is to be condensed and that is used as the heat transfer medium is distributed via a collector/distributor 6 into the nitrogen passages and on the lower end of the condenser block 1 is funneled into a collector 5 as liquid and removed.

On the oxygen side, the condenser block 1 is divided into five circulation sections 7*a* to 7*e* that each have one entry and one exit area 9, 10 with horizontally running plates and the actual heat exchange area 8 with vertical channels. All entry openings 9 and exit openings 10 lie on the same side of the condenser block 1.

On the open side 12 of the condenser block 1, there are likewise liquid storage tanks 20 and separation spaces 21. The liquid drains between the stages 15 via overflow pipes 30. The top edge of the overflow pipes 30 is at the same height with the top edge of the pertinent circulation section 7. This results in that the oxygen passages 8 and the corresponding entry and exit passages 9, 10 are always completely in the liquid bath. The evaporation passages 8 are always filled with liquid, by which shifting of the passages 8 by high-boiling components is prevented.

What is claimed is:

1. A bath condenser with a condenser block having at least 2 sides and comprising evaporation passages for a liquid and liquefaction passages for a heating medium and at least two circulation sections located on top of one another, the evaporation passages each having on the lower end of a circulation section at least one entry opening for the liquid and on the upper end of the circulation section at least one exit opening, and means for routing liquid from said at least one exit opening of a circulation section directly to an entry opening of an underlying circulation section, and wherein the means (17, 30) for routing the liquid connect only exit openings (10) and entry openings (9) that are located on the same side (12) of the condenser block (1).

2. A bath condenser according to claim 1, wherein at most two sides (12) of the condenser block (1) are provided with entry (9) and/or exit openings (10).

3. A bath condenser according to claim 1, wherein all entry (9) and exit openings (10) are located on the same side (12) of the condenser block (1).

4. A bath condenser according to claim 1, wherein the flow connection between the entry (9) and exit openings (10) and the evaporation passages (8) is established by horizontally running channels.

5. A bath condenser according to claim 1, wherein a collector (13) provided with a liquid feed line (22) and a gas offtake (18) substantially surrounds and is substantially coextensive with the entry (9) and/or exit openings (10) of the circulation section (7), and is attached to one side of a circulation section (7) in which the entry (9) and/or exit openings (1) are located.

6. A bath condenser according to claim 1, wherein a collector (13) provided with a liquid feed line (22) and a gas offtake (18) substantially surrounds and is substantially coextensive with the sides of several circulation sections (7), and is attached to one side (12) of the condenser block (1) in which the entry (9) and/or exit openings (1) are located.

7. A bath condenser according to claim 6, wherein the collector (13) along the boundary of two circulation sections (7) at a time is divided into stages (15), two adjacent stages (15) being connected to one another via one liquid line (17, 30) and one gas line (18) on the flow side.

8. A bath condenser according to claim 7, wherein two adjacent stages (15) are connected to one another via an overflow pipe (30) on the flow side.

9. A bath condenser according to claim 7, wherein the collector (13) is divided into stages (15) by flat sheets (16) or elbowed bottoms.

10. A bath condenser according to claim 7, wherein the inlet into the gas line (18) of one stage (15) is located above the exit opening (10) of the evaporation passages (8) of the stage (15).

11. A bath condenser according to claim 7, wherein the collector (13) in a plane perpendicular to the liquefaction passages (2) and evaporation passages (8) has a semicircular or semielliptical cross-section.

12. A bath condenser according to claim 7, wherein the liquid line (17, 30) and/or gas line (18) that joins two stages (15) runs within the collector (13).

13. A bath condenser according to claim 7, wherein the gas inlet of the gas line (18) is located on the side facing away from the exit opening (10) of the evaporation passages (8).

14. A bath condenser according to claim 7, wherein the gas line (18) extends through all stages (15).

15. A bath condenser according to claim 1, wherein the liquefaction passages (2) extend over the entire height of the condenser block (1).

16. In a low temperature air separation system comprising a high pressure column, a low pressure column and in communication with both columns a main condenser for condensing nitrogen in the high pressure column and for vaporizing oxygen in the low pressure column, the improvement wherein the main condenser is a bath condenser according to claim 1.

17. A bath condenser according to claim 5, wherein said collector (13) is adjacent and substantially coextensive with the entire side of the circulation section (7).

18. A bath condenser according to claim 6, wherein said collector (13) is adjacent and substantially coextensive with the entire side (12) of the condenser block.

19. A bath condenser with a condenser block having at least 2 sides and comprising, evaporation passages for a liquid and liquefaction passages for a heating medium and at least two circulation sections located on top of one another, the evaporation passages each having on the lower end of a circulation section at least one entry opening for the liquid and on the upper end of the circulation section at least one exit opening, and means for routing liquid from said at least one exit opening of a circulation section directly to an entry opening of an underlying circulation section, and wherein the means (17, 30) for routing the liquid connect only exit openings (10) and entry openings (9) that are located on the same side (12) of the condenser block (1), and further comprising a collector (13) provided with a liquid feed line (22) and a gas offtake (18) adjacent and substantially coextensive with at least one side of a circulation section (7) which flows along the boundary of two circulation sections (7) in time is divided into stages (15), two adjacent stages (15) being connected to one another via one liquid line (17, 30) and one gas line (18) on the flow side is disposed.

20. A bath condenser according to claim 18, wherein said collector (13) is attached to one side (12) of the condenser block (1) in which the entry (9) and/or exit openings (1) are located.

* * * * *